United States Patent [19]

Peace

[11] 4,125,191

[45] Nov. 14, 1978

[54] MAGNETIC SEPARATION OF MATERIALS

[75] Inventor: John Peace, Guisborough, England

[73] Assignee: British Steel Corporation, London, England

[21] Appl. No.: 720,598

[22] Filed: Sep. 7, 1976

[30] Foreign Application Priority Data

Sep. 5, 1975 [GB] United Kingdom ..... 36676/75
Sep. 30, 1975 [GB] United Kingdom ..... 39968/75

[51] Int. Cl.[2] ..... B07C 5/04

[52] U.S. Cl. ..... 209/609; 209/215; 209/223 A

[58] Field of Search ..... 209/82, 111.8, 213, 209/214, 215, 223 R, 223 A, 225

[56] References Cited

U.S. PATENT DOCUMENTS

| | | | |
|---|---|---|---|
| 2,059,229 | 11/1936 | Gregg | 209/215 |
| 3,042,205 | 7/1962 | Merwin | 209/223 R X |
| 3,552,564 | 1/1971 | Burgener et al. | 209/214 |
| 3,809,239 | 5/1974 | Barrett et al. | 209/111.8 |
| 3,926,792 | 12/1975 | Buford | 209/215 |
| 4,055,489 | 10/1977 | Soley | 209/223 A X |

FOREIGN PATENT DOCUMENTS

| | | | |
|---|---|---|---|
| 311,916 | 4/1919 | Fed. Rep. of Germany | 209/223 A |
| 227,019 | 1/1925 | United Kingdom | 209/214 |

*Primary Examiner*—Joseph J. Rolla
*Attorney, Agent, or Firm*—Bacon & Thomas

[57] ABSTRACT

Fragments of ferromagnetic material, such as tin can pieces, are sorted by size on apparatus including an inverted conveyor that carries fragments that have been previously oriented with their longest axes placed in parallel directions past a line of magnets spaced progressively further apart in the direction of orientation of the fragments. The magnets attract the fragments strongly to the conveyor directly under the magnets, but progressively more weakly in those spaces between the magnets so that the shorter pieces separate gravitationally from the conveyor sooner than the longer pieces. Fragments having varying magnetic susceptibility, such as, for example, tin can pieces with and without attached normally round aluminum tops, are also separated according to their magnetic susceptibility by conveying the fragments beneath carefully spaced magnetic devices whereby the fragments of lower susceptibility drop from the conveyor sooner than those of higher susceptibility due to the weaker magnetic field between magnetic devices. The spacing between magnetic devices, for example, can be slightly greater than the diameter of an aluminum top in the case of the exemplary fragments.

17 Claims, 2 Drawing Figures

MAGNETIC SEPARATION OF MATERIALS

Figure 1:
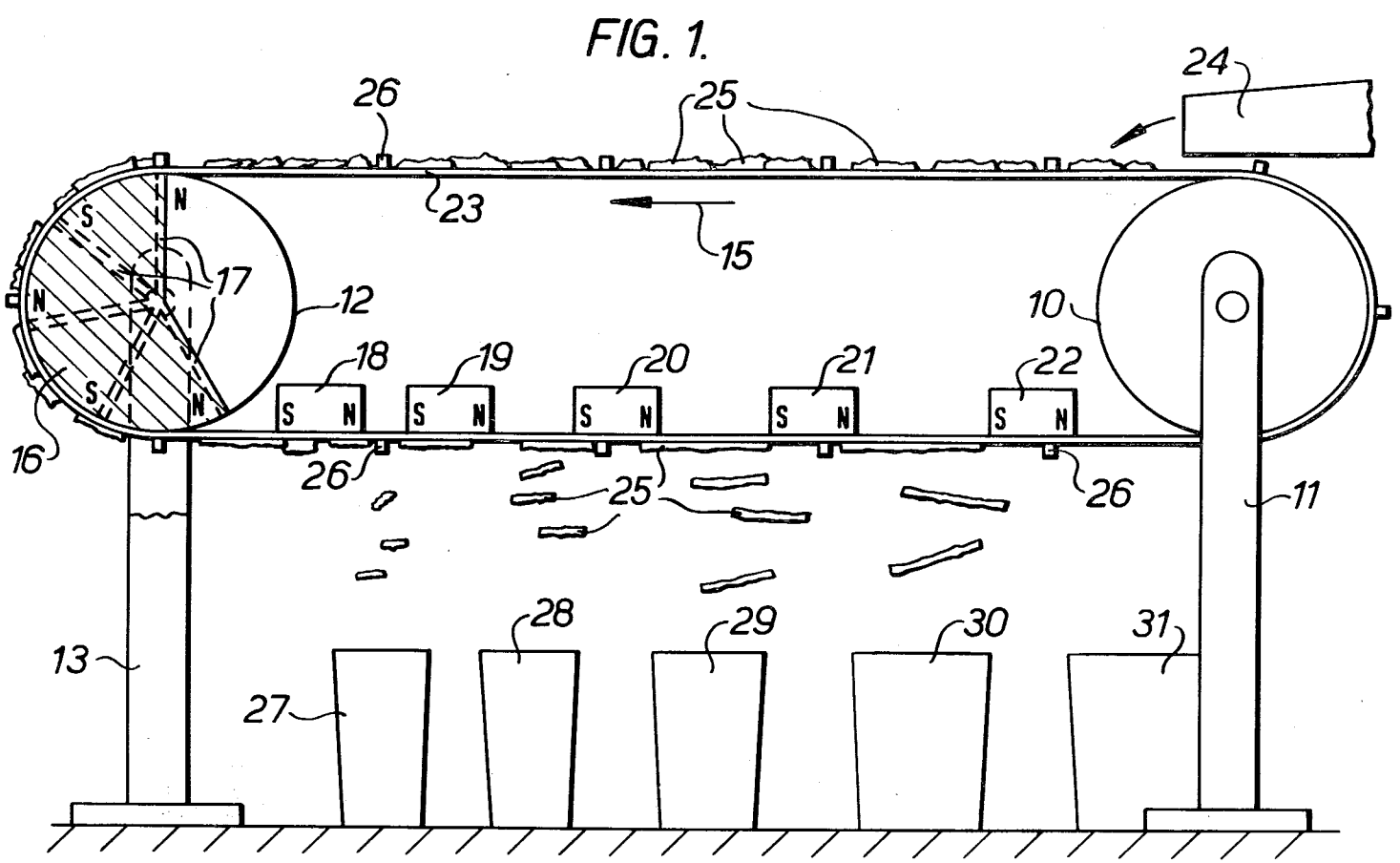

This invention relates to the magnetic separation of materials. In one particular form it is concerned with providing a method and apparatus for the separation of fragments of ferromagnetic material according to their respective sizes.

The separation by size of granular materials is frequently carried out by allowing the materials to fall through one or more screens, the mesh of which determines the size of the particles which are retained by the respective screen. With certain materials however, such as fragmented automobile or consumer durable scrap, the length to width ratio of individual fragments varies and with some fragments may be large. If accurate separation by size is required for these fragments, then conventional screens are not very satisfactory. For instance, a steel bar 8 cm square and 30 cm long could pass through screen having a 10 cm square screen mat or mesh and then be sized as −10 cm. Furthermore, fragmented metal scrap can obstruct or "blind" a conventional screen, because intertwined fragments of scrap will easily get stuck partly in the apertures of the screen mat.

It is an object of the invention to provide a method and apparatus for separating fragments of ferromagnetic material according to their size which ameliorates the problem previously referred to.

According to one aspect of the invention an apparatus and method is provided for continuously separating fragments of ferromagnetic material from one another according to their size, including orienting the fragments by suitable means so that their respective longest dimensions extend in a common direction, supporting and conveying the fragments from the orienting means along a line of magnetic devices which are arranged so as to maintain the initial orientation of the fragments, to attract the fragments to the support, and which are spaced from one another in the direction of fragment orientation so that the field between adjacent magnets is weaker than the field directly opposite each magnet, and exposing the fragments to a force tending to separate the fragments from the supporting means whereby the shorter fragments are separated from the longer fragments as the fragments are conveyed past the magnetic devices.

The means for orienting the fragments may include a rotatable drum incorporating a static magnet arrangement around which in use the fragments are conveyed, the drum having a number of magnets arranged circumferentially about and within the drum with the magnetic poles radially arranged adjacent the surface of the drum being alternately north and south such that the ferromagnetic fragments are oriented with their respective longest dimension in the direction of rotation of the drum.

The fragments may be supported and conveyed by means of a continuous conveyor belt beneath and closely adjacent the line of magnetic devices. The conveyor may be fed with fragments on its upright upper surface, the fragments then passing around the rotatable drum incorporating the static magnet arrangement before being carried by the inverted conveyor belt surface beneath and closely adjacent to the line of magnetic devices so that the force of gravity can be used to separate the fragments from the conveyor surface. The continuous conveyor belt with its line of magnetic devices may be arranged so that it lies overhead and closely adjacent to another conveyor carrying the ferromagnetic fragments. In this case the initial orientation of the fragments may take place as they are attracted upwardly from the other conveyor belt to the inverted first recited conveyor belt adjacent to the first of the magnetic devices along the line of which they are to be conveyed. The conveyor belt may have projections extending from its carrying surface, which projections assist in the conveyance of the fragments.

The spacing between adjacent magnetic devices preferably is progressively increased in the direction of orientation of the longest dimensions of the fragments along the line of the magnetic devices. The devices may comprise permanent magnets or alternatively they may be electromagnets.

In another particular form the invention is concerned with the separation of fragments different magnetic susceptibility, particularly ferromagnetic fragments and fragments which are only partly comprised of ferromagnetic material.

Metal scrap material is used as a feedstock for furnaces in a number of metal-producing processes. The scrap material is normally required to contain only a limited quantity of contaminants, since this could otherwise give rise to the production of metal melts which are outside the specifications required. For example, in the manufacture of steel, steel scrap from autobodies, consumer scrap and scrap arising from the stamping and cutting out of steel components is used as feedstock in an electric arc furnance for the production of high quality steels. Various separation techniques are known for removing contaminants in the form of other metallic and non-metallic substances from this steel scrap. Typical of these processes are magnetic separating devices.

One type of scrap material which could be used as feedstock for furnaces is the so-called tin can. The tin can is of course made primarily of steel and has a very thin coating of tin. If the tin can be removed by chemical treatment then the de-tinned cans provide valuable scrap. In recent years however it has become the practice to make beverage and other sorts of cans which are fitted with an aluminium "Ring Pull" lid at the top of the can, the body and the base of the can being made of tinned steel. If the aluminium lids are permitted to enter a chemical de-tinning bath together with the rest of the can, the de-tinning liquor is rapidly contaminated causing the bath to give off hydrogen gas which is a considerable safety hazard. Furthermore de-tinning baths contaminated with aluminium are unsuitable for recycling. This means that the process becomes very expensive.

If the cans are broken up prior to de-tinning, in theory the aluminium lids could be separated from the substantially ferromagnetic parts of the cans by a conventional magnetic separation technique. It has been found however that when the cans are fragmented many of the fragments of aluminium lid have attached to them a steel skirt, or annulus in the case of a complete lid, which prevents separation by conventional separators because the skirt or annulus which is ferromagnetic is also attracted by the magnets. Thus a considerable proportion of the aluminium can lids end up in the supposedly aluminium-free scrap which is to be supplied to the de-tinning bath.

It is an object of this invention to provide a method and apparatus for separating fragments of ferromagnetic material from fragments which are only partly comprised of ferromagnetic material.

According to this embodiment of the invention fragments of substantially ferromagnetic material are separated from fragments which are only partly comprised of ferromagnetic material by passing the unseparated material while supported on a suitable surface through a series of magnetic fields of different intensities thereby permitting the fragments which are only partly comprised of ferromagnetic material to be separated from the fragments of ferromagnetic material during the periods when the unseparated material passes through a magnetic field of relatively low intensity and the fragments are exposed to a suitable force tending to cause them to separate from the support surface. The line of magnets preferably are spaced from one another in the direction of conveyance of the unseparated material, the strength of the magnets and the spacing between them being such that the fragments which are only partly comprised of ferromagnetic material (low magnetic susceptibility) fall under gravity away from the line of magnets at the spaces between the magnets, whilst fragments of ferromagnetic material (higher susceptibility) continue in the direction of conveyance.

The magnets may be spaced from one another at equal intervals. Alternatively the magnets may be spaced from one another at increasing intervals along the line of the magnets. The magnets may be of the permanent variety, e.g. ferrites, or alternatively they may be electromagnets.

The means for conveying the unseparated material preferably is a continuous conveyor belt. The conveyor belt may have protrusions extending from its carrying surface so as to engage fragments of material and carry them with the belt. The protrusions may be "flights" extending perpendicular to the surface of the belt. Alternatively the protrusions may be in the form of non-ferrous or rubber studs. The continuous conveyor belt at one end of its travel may extend around a rotatable drum which contains a static magnet device or assembly. The magnet assembly is arranged so as to hold ferromagnetic fragments and fragments which are only partly comprised of ferromagnetic material to the belt as it passes around the drum.

The unseparated material may include fragments of tin cans which are substantially wholly ferromagnetic and fragments comprising aluminium can tops having a portion of ferromagnetic can attached to them.

Figure 2:
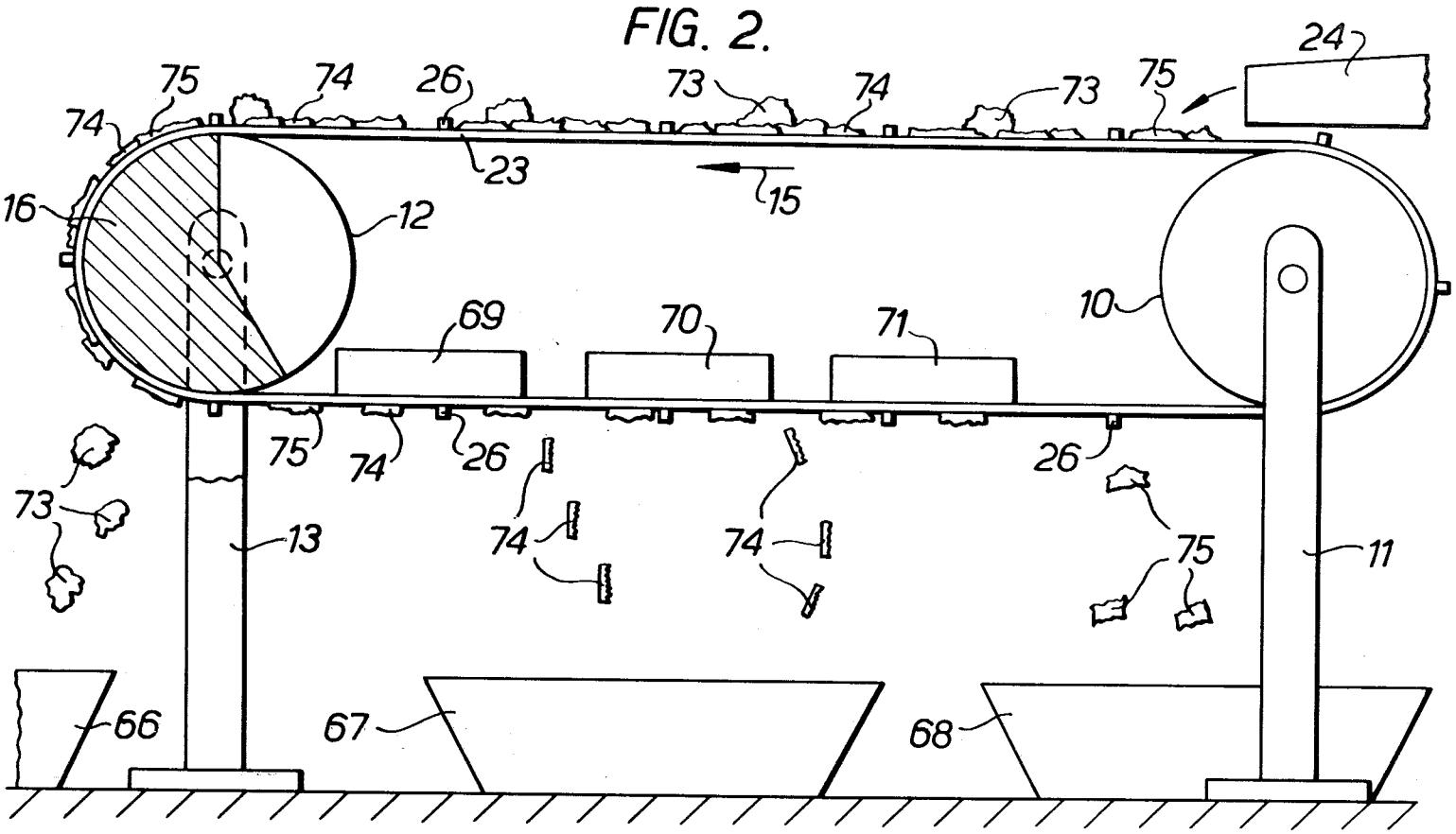

Two specific embodiments of the invention will now be described by way of example only, with reference to the accompanying drawings in which:

FIG. 1 shows a schematic view of a separator in elevation and partly in cross-section, and FIG. 2 shows a schematic view of a separator in elevation.

As shown in FIG. 1 a first drum 10 is rotatably mounted on a support structure 11. A second drum 12 is rotatably mounted on a second support structure 13, the first drum 10 being spaced in a horizontal direction from the second drum 12. The first drum 10 is rotatably driven by drive means which for the sake of clarity is not shown in the drawing. A continuous rubber belt conveyor 23 extends around the two drums 10 and 12 and is thereby driven in the direction indicated by arrow 15. As shown, the conveyor includes an upright upper horizontal surface and a lower inverted horizontal surface.

The second drum 12 contains within it a drum magnet arrangement 16 which is static relative to the drum 12, the field of influence of the drum magnet arrangement 16 extending over rather more than half the circumference of drum 12 at any one moment. The drum magnet arrangement 16 consists of a number of magnets 17 arranged circumferentially and radially within drum 12 with their magnetic poles adjacent the surface of drum 12 being alternatively north and south.

A line of spaced magnetic devices 18, 19, 20, 21 and 22 respectively extend above and closely adjacent to the lower inverted surface of conveyor belt 23. The first magnetic device 18 is close to the drum magnet arrangement 16, such that there is substantial magnetic field extending between said drum magnet arrangement 16 and the first magnetic device 18. Each magnetic device 18, 19, etc. is spaced from its neighbouring magnetic device by a gap. The gap between the respective devices 18, 19, etc. increases along the line of devices e.g. the second magnetic device 19 is spaced from the third magnetic device 20 by a gap slightly larger than that between the first magnetic device 18 and the second magnetic device 19. The polarity of the respective magnetic devices is such that their north poles are all aligned in the same direction along the line of the devices. The field strength of the magnet devices and the spacing of each gap is such that a magnetic field extends across each gap and through the belt conveyor 23, but that the field strength towards the middle of a gap gets weaker the further the respective gap is away from the second drum 12.

A vibrating feeder 24 supplies the upper surface of belt conveyor 23 with fragments of steel scrap 25 of varying dimensions. The belt conveyor 23 has protrusions from its carrying surface in the form of rubber "flights" 26 which extend at regular intervals across the width of the belt conveyor 23. Flights 26 assist in making the fragments 25 move with the belt conveyor 23. As the fragments 25 pass around the second drum 12 the drum magnet arrangement 16 within the drum 12 causes the fragments 25 to be aligned or oriented by the magnetic field arising from magnets 17 so that their respective longest dimensions extend in a common direction. This common direction extends along the line of magnet devices 18, 19 etc. as the fragments 25 leave the field of influence of the drum magnet arrangement 16 in the embodiment illustrated. Thus, the fragments are oriented here so that their longest axes lie in a radial plane extending normal to the axis of rotation of drum 12.

Thus, when fragments 25 are conveyed across the gap between the first and second magnet devices 18 and 19, fragments having a longest dimension substantially shorter than the space across this gap will fall from the belt conveyor 23 into a first receptacle 27 placed beneath the gap. Similarly, fragments 25 having a slightly larger longest dimension will fall from the belt conveyor 23 into a second receptacle 28 when they reach the gap between the second and third magnet devices 19 and 20. This process of separation continues as the remaining steel fragments pass across gaps of increasing size or decreasing field strength, the fragments falling into further receptacles 29, 30, 31 according to the length of their largest dimensions. Each respective receptacle 27 to 31 thus receives fragments of a particular size range.

Large fragments of scrap may also be separated from the remainder of the fragments as they pass around the second drum 12. This can be done by using a predetermined belt speed and drum diameter such that fragments above a certain size are thrown off into a suitable receptacle.

The embodiment of the invention shown in FIG. 1 is particularly useful for the sizing of steel scrap for continuously charging electric arc furnaces, since unless accurate sizing takes place, then the hoppers and shutes used for charging can easily be blocked by oversize scrap fragments.

As shown in FIG. 2 (in which items having corresponding parts in FIG. 1 have been given the same reference numerals) a continuous rubber conveyor belt 23 extends around two rotatable drums 10 and 12, the first drum 10 having drive means (not shown) so that the belt 23 is driven in an anticlockwise direction 15 through frictional engagement with said first drum 10. The second drum 12 is not driven, and contains within it a static magnetic device 16 whose attractive magnetic field extends through the belt 23 as it passes around the drum 12. The drums 10 and 12 are supported respectively for rotation about a horizontal axis on pillars 11 and 13.

Three magnets 69, 70 and 71 respectively are mounted in a line just above the inverted lower surface of belt 23. The second magnet 70 is then spaced from the first magnet 69 and the third magnet 71 from the second magnet 70 by a distance slightly greater than the diameter of a typical aluminium top of a tin can to be processed by the apparatus. The magnets 69, 70 and 71 are plate magnets, i.e. they each comprise a number of permanent ferrite bar magnets mounted on a steel plate. The magnets are arranged so that their respective north poles point in the same direction along the line of the magnets.

Three hoppers 66, 67 and 68 respectively, are positioned beneath the conveyor belt 23. The first hopper 66 is beneath the end of the conveyor belt as it passes around second drum 12. The second hopper 67 is beneath the lower surface of belt 23 such that it extends between the first and the third magnets 69 and 71 respectively. The third hopper 68 is also beneath the lower surface of belt 23 but it is positioned under the end of the third magnet 71 which is closest to the first drum 10 and extends towards first drum 10.

Fragmented tin can scrap is supplied to the upright upper surface of belt 23 from a vibrating feeder 24 and carried along to the second drum 12. The scrap comprises, for example, fragments of substantially ferromagnetic tin can 75, fragments of completely non-ferrous material 73 such as organic material, dirt and non-ferrous metals, and aluminium can lids 74 with skirts of ferromagnetic can attached to them. Typically, the fragments are supplied from a crusher (not shown) which in turn is fed with bales of cryogenically cooled tin cans.

As the belt 23 travels around the second drum 12 the completely non-ferrous fragments 73 fall off the belt 23 and into the first hopper 66 under the influence of gravity. Both the fragments of substantially ferromagnetic tin can 75 and the aluminium can lids 74 with skirts of ferromagnetic can attached to them are held to the belt 23 as it passes around the second drum 12 by virtue of the magnetic field generated by the magnet device 16 within the second drum 12. Note that the magnet device 16 extends around greater than 180 degrees so that fragments 74 and 75 are held to the belt 23 as it commences its lower travel.

The belt 23 has rubber flights 26 attached to its carrying surface at intervals around it. The flights 26 extend across the width of the belt 23 and act to push the fragments of material along in the horizontal direction, since particularly on the lower surface of belt 23, the frictional contact between belt 23 and the various fragments is relatively low. Fragments 74 and 75 are thus conveyed beneath and closely adjacent to the lower surface of the first magnet 69. At the space between the first magnet 69 and the second magnet 70 the magnetic field extending through the belt 23 and which holds fragments 74 and 75 on the belt against the force of gravity is weakened. The spacing between the magnets and the field strength of the magnets is such that high susceptibility fragments of tin can 75 which are substantially ferromagnetic are carried over the space to the second magnet 70, whilst most of the low susceptibility aluminium can tops 74 with skirts of ferromagnetic material attached to them fall from belt 23 into the second hopper 67.

Similarly the spacing between the second magnet 70 and the third magnet 71 ensures that any can tops 74 with skirts which might just have passed over the space between the first and second magnets are dropped from the belt 23. The magnetic field between the second and third magnets 70 and 71 may be different from that between the first two magnets so that can tops with relatively large skirts can be dropped at the second space, the tops with relatively small skirts having been dropped at the first space (i.e. that between the first and second magnets 69 and 70 respectively). Very small fragments of tin can itself may fall from the belt 23 at the spaces between the magnets. These can later be separated from the can lids by conventional screening arrangements. The larger fragments of substantially ferromagnetic tin can 75 however pass over both the spaces between the magnets and are ultimately dropped into the third hopper 68 after passing under the third magnet 71.

The embodiment of the invention shown in FIG. 2 may alternatively be used for separating other non-ferrous fragments (e.g. copper) which have small ferromagnetic attachments from substantially wholly ferromagnetic fragments.

I claim:

1. A method for continuously separating various size fragments of ferromagnetic material from one another according to their size including the steps of:

(a) orienting the fragments upon a support surface so their respective longest dimensions extend in a common direction;

(b) conveying the fragments while they are on the support surface along a line of magnetic devices which maintain the initial orientation of the fragments and which are arranged to attract the fragments to the support surface, the magnetic devices being located along the fragment conveying direction and spaced apart from one another progressively greater distances along the direction of orientation of the longest dimensions of the fragments; and (c) exposing the fragments to a force tending to separate the fragments from the support surface at least when the fragments pass between adjacent magnetic devices spaced apart a sufficient distance such that their magnetic influence is insufficient to retain the smaller of the passing fragments on the support surface.

2. The method according to claim 1 wherein the support surface is a surface of a continuous belt conveyor, and including the steps of feeding the fragments to the conveyor surface; magnetically orienting the fragments on the conveyor surface so their longest dimensions extend in a common direction; positively driving the fragments along the line of magnetic devices while they are on the conveyor;and utilizing the force of gravity as the force tending to separate the fragments from the conveyor surface.

3. The method according to claim 2 including magnetically orienting the fragments by passing them over a rotatable drum having a fixed magnetic orienting means therein while the fragments are supported on the belt conveyor surface.

4. The method according to claim 3 including feeding the fragments to the surface of the conveyor before they are exposed to any magnetic orienting influence.

5. The method according to claim 3 including placing the fragments on a generally horizontal surface of the conveyor while it is in a non-inverted condition, then passing the conveyor surface with the fragments thereon over the rotatable drum and along the magnetic devices while in an inverted condition so that the fragments are attracted to the conveyor surface in succession by the drum and then by the magnetic devices until the influence of the latter is insufficient to retain the fragments on the conveyor surface against gravitational forces.

6. A method of classifying and separating fragments according to their magnetic susceptibility comprising:

(a) placing fragments having varying magnetic susceptibility upon a movable supporting and conveying surface;

(b) conveying the fragments by means of the moving surface past a line of magnetic devices the field strengths of which are maintained constant during normal operation and that are spaced apart from each other by predetermined distances, and each of which provides a steady predetermined magnetic field tending to strongly attract the fragments passing directly opposite the magnetic devices to the moving surface and to only weakly attract the passing fragments to the moving surface between the magnetic devices; and (c) exposing the fragments to forces tending to cause their separation from the moving surface while they are conveyed past the magnetic devices;

whereby fragments of lower magnetic susceptibility will be separated from the moving surface while they pass between adjacent magnetic devices, and fragments of higher magnetic susceptibility will be conveyed at least to the last of the magnetic devices in the line.

7. The method according to claim 6, wherein the fragments comprise at least pieces of tin cans, and pieces of composite tin cans and normally round aluminum top sections, and the magnetic devices are spaced apart a distance slightly greater than the diameter of the aluminum can tops.

8. The method according to claim 6 wherein the moving supporting and conveying surface is a portion of continuous belt conveyor arranged so that a surface thereof runs generally horizontally beneath the line of magnetic devices in inverted condition, the fragments being conveyed past the magnetic devices while they are attracted to the inverted surface by the latter; and wherein the fragments of lower susceptibility are separated from the inverted surface by gravitational forces.

9. The method according to claim 8 wherein the conveyor is arranged so that a surface thereof runs generally horizontally in upright condition outside the area of influence of said magnetic devices, and including feeding the fragments to the upright surface, and running the conveyor with the fragments thereon over a drum having stationary magnetic devices therein that attract and hold the fragments against the conveyor passing over the drum immediately before the fragments pass the first magnetic device of said line of magnetic devices, the conveyor surface becoming inverted beyond the drum, the first of the magnetic devices in the line being spaced adjacent the drum sufficiently close and having sufficient field strength so that all the magnetic fragments being conveyed are attracted to the inverted conveyor surface at least up to the first magnetic device.

10. Apparatus for continuously separating fragments of ferromagnetic material from one another according to their size, comprising means for orienting the fragments so their respective longest dimensions extend in a common direction; a line of magnetic devices; means for supporting and conveying the fragments from the orienting means along the line of magnetic devices, said devices being arranged to maintain the initial orientation of the fragments and to attract the fragments against the supporting means while they are conveyed, the magnetic devices being spaced apart from one another progressively greater distances along the direction of orientation of the longest dimensions of the fragments whereby the fragments can be separated from the supporting means by a separating force at least when the fragments pass between adjacent magnetic devices that are spaced sufficiently apart such that their combined attractive force is insufficient to retain the fragments against such separating force.

11. Apparatus as claimed in claim 10 in which the direction of orientation of the longest dimensions of the fragments extends along their direction of conveyance.

12. Apparatus as recited in claim 10 including a continuous conveyor belt including a length of surface that runs in an inverted condition and wherein said magnetic devices are located above the inverted surface, said supporting and conveying means comprising at least a portion of said inverted surface, whereby the fragments are attracted upwardly towards and conveyed upon the inverted surface beneath and closely adjacent the line of magnetic devices for so long as the magnetic attractive force is sufficient to so attract them against gravitational force and are caused to separate from the surface gravitationally when the magnetic attractive force is insufficient to so attract them.

13. Apparatus as recited in claim 12 in which the means for orienting the fragments includes a rotatable drum over which the conveyor belt runs, the drum incorporating therein a number of magnets statically arranged circumferentially about and within the drum so that magnetic poles are adjacent the surface of the drum and oriented alternately north and south, said conveyor belt transporting said fragments about the drum in a manner such that the ferromagnetic fragments are attracted to the conveyor while they pass over the drum and are oriented with their respective longest dimensions extending generally parallel to a radial plane extending normal to the axis of rotation of the drum.

14. Apparatus as recited in claim 13 wherein the conveyor belt includes a length of surface that runs in a non-inverted condition, and including means for feeding the fragments onto the non-inverted surface in advance of the drum.

15. Apparatus for classifying and separating fragments in accordance with their magnetic susceptibility comprising:

(a) a fragment conveying means including a movable supporting surface;

(b) means for feeding magnetic fragments having varying magnetic susceptibility onto the movable supporting surface of the conveying means;

(c) a row of magnetic devices each having a constant field strength during normal operation and being spaced apart by predetermined distances along the direction of travel of the conveying means, said magnetic devices being capable of attracting the fragments towards and against the supporting surface in opposition to a force tending to separate them from the supporting surface when the fragments are conveyed past the magnetic devices;

(d) the predetermined distance between the magnetic devices corresponding to the distance that results in the magnetic field between adjacent magnetic devices being insufficient to attract and hold fragments having a susceptibility below a predetermined level to the supporting force in opposition to such separating force;

whereby the fragments can be separated from the supporting surface by a separating force in accordance with their susceptibility at least while the fragments are being conveyed between magnetic devices.

16. Apparatus according to claim 15 wherein the fragments comprise pieces of tin cans, and composite pieces of tin cans and normally round aluminum tops, the predetermined spacing between magnetic devices being slightly larger than the diameter of the aluminum tops.

17. Apparatus according to claim 16 wherein the conveying means is a continuous belt conveyor having a pair of generally horizontal surface sections, one section being upright and the other inverted; a drum over which the conveyor runs between the upright and inverted surface sections; a fixed magnetic means within the drum; the means for feeding the fragments onto the supporting surface being arranged to feed the fragments onto the upright conveyor surface section before that surface runs over the drum; said row of magnetic devices spaced along and above the inverted conveyor surface section with the first magnetic device being located closely adjacent the drum, whereby fragments placed upon the conveyor are attracted to the conveyor surface while the conveyor runs over the drum and at least until the fragments reach the first magnetic device; and protrusions in the form of non-magnetic studs on the conveyor for positively driving the fragments past the drum and the magnetic devices while the fragments are attracted to the conveyor.

* * * * *